US008254810B2

(12) United States Patent
Nagase et al.

(10) Patent No.: US 8,254,810 B2
(45) Date of Patent: Aug. 28, 2012

(54) IMAGE FORMING APPARATUS

(75) Inventors: Hisayoshi Nagase, Hachioji (JP); Hiroshi Funabiki, Uenohara (JP)

(73) Assignee: Konica Minolta Business Technologies, Inc. (JP)

( * ) Notice: Subject to any disclaimer, the term of this patent is extended or adjusted under 35 U.S.C. 154(b) by 224 days.

(21) Appl. No.: 12/837,623

(22) Filed: Jul. 16, 2010

(65) Prior Publication Data

US 2011/0020033 A1 Jan. 27, 2011

(30) Foreign Application Priority Data

Jul. 21, 2009 (JP) ..... 2009-169897

(51) Int. Cl.
*G03G 15/16* (2006.01)

(52) U.S. Cl. ..... 399/122; 399/322

(58) Field of Classification Search ..... 399/122, 399/322

See application file for complete search history.

(56) References Cited

FOREIGN PATENT DOCUMENTS

| | | | |
|---|---|---|---|
| JP | 9-265219 | A | 10/1997 |
| JP | 2003-263090 | A | 9/2003 |
| JP | 2004-287317 | A | 10/2004 |

*Primary Examiner* — David Gray
*Assistant Examiner* — Laura Roth
(74) *Attorney, Agent, or Firm* — Cantor Colburn LLP

(57) ABSTRACT

An image forming apparatus, comprises an image forming section; a pair of fixing members coming in pressure contact with each other so as to form a nip portion and to fix a toner image on a sheet conveyed from the image forming section with the nip portion; an oscillating section to oscillate the fixing members in a width direction perpendicular to a sheet conveying direction; an inclining section to incline the fixing members to the width direction in parallel to a conveyance surface; and a control section to control the oscillating section and the inclining section such that when a sheet is passing through the nip portion, a direction of a one-sided oscillation shift of the sheet due to the oscillation of the fixing members is made opposite to that of a one-sided inclination shift of the sheet due to the inclination of the fixing members.

9 Claims, 10 Drawing Sheets

TEMPERATURE ON
A FIXING ROLLER

IMAGE FORMING APPARATUS

This application is based on Japanese Patent Application No. 2009-169897 filed on Jul. 21, 2009, in Japanese Patent Office, the entire content of which is hereby incorporated by reference.

BACKGROUND OF THE INVENTION

The present invention relates to a fixing device and an image forming apparatus which fix an image formed on a sheet.

In recent years, in electro-photographic type image forming apparatuses, such as printers and digital composite machines, demands of commercial markets become strong for a performance capable of outputting images with high quality in large amounts at high speed and the longer service life of components associated with the electro-photographic process.

In order to respond to such demands of commercial markets, desired is a technique to disperse positions where the edge portions of a sheet comes in contact with the surface of a fixing roller, by oscillating a fixing device in the width direction of the sheet when the sheet passes through the fixing device. As a result, it becomes possible to prevent wavy abrasion from taking place on a fixing roller in parallel to edge portions of a sheet when sheets with the same size are continuously repeatedly conveyed to the fixing device, whereby poor image quality (image streaks) due to the wavy abrasion on the fixing roller can be avoided.

On the other hand, if the fixing device is displaced on the condition that a sheet is held between a transfer section and the fixing device, new problems such as wrinkles on the sheet and image defects (insufficient fixing, unevenness in glossiness) due to imbalance of heat supplied to the sheet may occur.

Such a technique to disperse the contact positions of the edge portions of a sheet is disclosed by Patent Documents 1 to 3.

In the image forming apparatus disclosed by Patent Document 1, arranged is a sheet conveying mechanism in which a sheet is inclined at a predetermined angle and conveyed into a fixing roller located at the upstream side in a fixing device. Therefore, when the inclined sheet passes through the fixing roller, the sheet is passing while shifting the contact positions of its side edge portions with the fixing roller in the axial direction of the fixing roller. As a result, since the contact positions of the side edge portions of the sheet with the fixing roller are changed continuously, the local wavy abrasion of the fixing roller can be avoided.

According to Patent Document 1, the contact positions of the edge portions of a sheet are dispersed in the shift width by which the sheet shifts in the inclined direction.

In the image forming apparatus disclosed in Patent Document 2, a position changing means capable of changing the position of a sheet in the width direction is provided at the upstream side of a transfer section of an image forming section, and the image forming section changes a start position to start forming an image in accordance with the position of a sheet conveyed to the transfer section.

As a result, the side edge portions of a sheet advancing into a nip portion of a fixing roller is changed and shifted in the width direction, whereby it becomes possible to avoid local wavy abrasion of the fixing roller.

In the image forming apparatus disclosed in Patent Document 3, the positional relationship between a sheet conveyed from a sheet feeding device and a transfer fixing member of a transfer fixing device is displaced relatively in the width direction, and whereby it becomes possible to avoid local wavy abrasion of the transfer fixing member caused by the side edge portions of sheets.

Patent document 1: Japanese Unexamined Patent Publication No. 9-265219

Patent document 2: Japanese Unexamined Patent Publication No. 2003-263090

Patent document 3: Japanese Unexamined Patent Publication No. 2004-287317

However, the abovementioned Patent Documents 1 to 3 have the following problems respectively.

In Patent document 1, the entire body of a sheet is shifted in an inclined direction between the fixing device and the transfer section, and the sheet having been shifted in the inclined direction is conveyed in the sheet conveying direction to the fixing device while keeping its attitude. Therefore, since it becomes necessary to employ the sheet conveying mechanism which is complicate and large in size, there are problems that cost increases and apparatus becomes large in size.

In Patent Document 2, since it is necessary to employ the position changing means to displace the entire body of a sheet in the width direction between the transfer section and the sheet feeding device, there are problems that cost increases and apparatus becomes large in size, as same as Patent document 1. Further, since the temperature distribution of the fixing roller changes to a sheet which advances into the fixing device, the balance in amount of heat supplied to each portion of a sheet is not stabilized, fixing failures, such as fixing unevenness (gloss, degree of fixing) and sheet wrinkles may occur.

In Patent Documents 3, since the transfer fixing member is displaced relatively to a sheet in the width direction, due to the same reason as Patent Document 2, there are problems that fixing unevenness (gloss, degree of fixing) may occur on a toner image on a sheet.

Further, the image forming apparatus is configured such that only the transfer fixing member is displaced in the width direction to a sheet which advances into the transfer fixing device. Accordingly, it is necessary to employ a mechanism to separate a pressing roller from the transfer fixing member at the time of shifting the transfer fixing member and a mechanism to urge the transfer fixing member in the axial direction with a strong power against the pressure contact of the pressing roller. Therefore, the image forming apparatus has some problems for practical use.

SUMMARY OF THE INVENTION

An object of the present invention is to improve the imbalance in amount of heat supplied to each portion of a sheet and the local wavy abrasion caused on the fixing roller, thereby providing an image forming apparatus which can achieve a long service life of a fixing roller without causing fixing unevenness and sheet wrinkles.

To achieve the abovementioned object, an image forming apparatus reflecting one aspect of the present invention is structure as follows.

An image forming apparatus, comprising:

an image forming section to form a toner image on a sheet;

a fixing device having a pair of fixing members coming in pressure contact with each other so as to form a nip portion and to fix the toner image on the sheet conveyed from the image forming section with the nip portion;

an oscillating section to oscillate the fixing members in a width direction perpendicular to a sheet conveying direction;

an inclining section to incline the fixing members to the width direction in parallel to a conveyance surface; and a control section to control the oscillating section and the inclining section such that when a sheet is passing through the nip portion, a direction of a one-sided oscillation shift of the sheet due to the oscillation of the fixing members is made opposite to that of a one-sided inclination shift of the sheet due to the inclination of the fixing members.

DETAILED DESCRIPTION OF THE PREFERRED EMBODIMENTS

Although the present invention is explained based on embodiments, the present invention is not limited to these embodiments. Further, this explanation does not limit the technical scope of claims and the meaning of terminology.

[Image Forming Apparatus]

Figure 1:
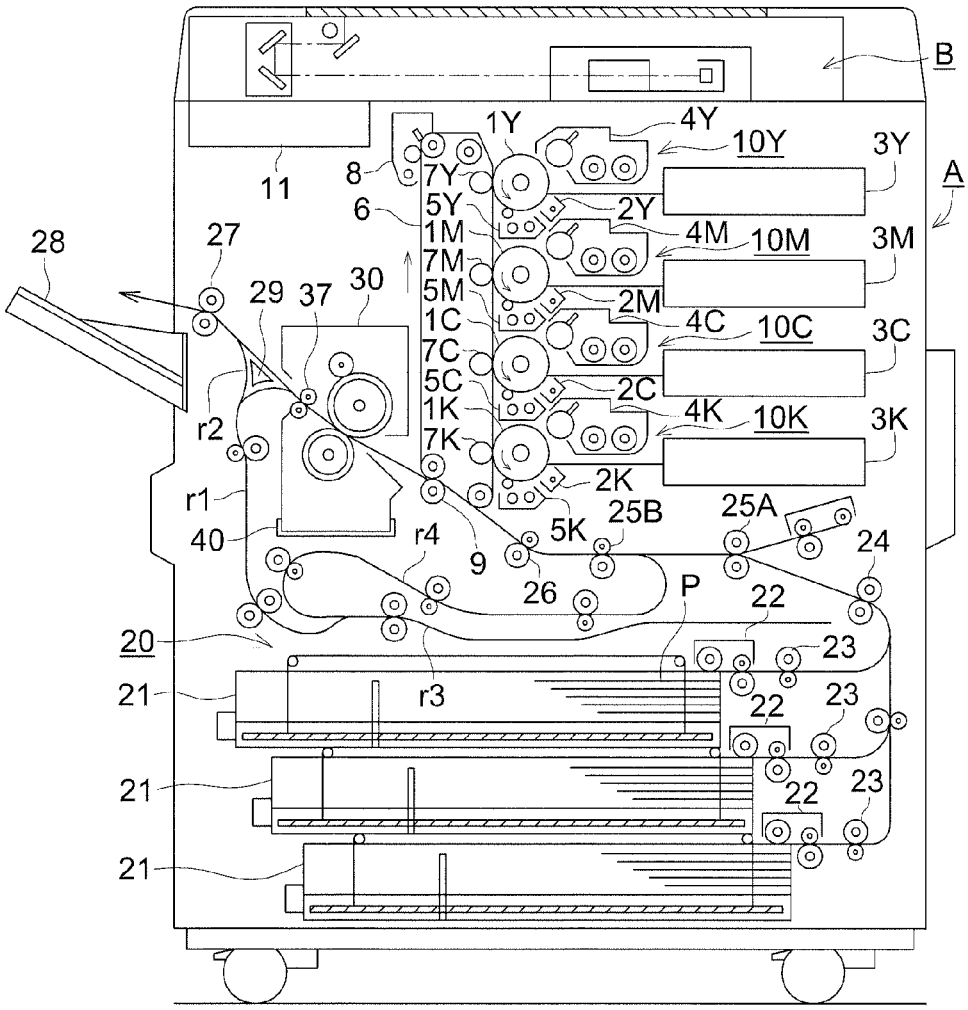
FIG. 1 is a structural diagram of an image forming apparatus A equipped with a fixing device according to the present invention.

FIG. 1 is a structural view of an image forming apparatus A equipped with a fixing device according to the present invention.

The image forming apparatus A is called a tandem type color image forming apparatus and is constituted with an image forming section 10, a sheet feeding device 20, and a fixing device 30. The image forming section 10 is constituted with plural sets of color image forming sections 10Y, 10M, 10C, and 10K and a transfer section.

On the upper part of the image forming apparatus A, provided is an image reading device B. An image on a document placed on a document stand is subjected to scanning exposure by an optical system of an image scanning exposing device of the image reading device B, and then the image is read by a line image sensor. In an image processing section, analog signals obtained through photoelectric conversion by the line image sensor are subjected to analog processing A/D conversion, shading correction, image compression treatment, and thereafter the resultant signals are inputted into exposing sections 3Y, 3M, 3C, and 3K.

A Y color image forming section 10Y to form an image of a yellow (Y) color comprises an electrically charging section 2Y, an exposing section 3Y, a developing section 4Y and a cleaning section 5Y which are arranged around a photoreceptor drum 1Y being as an image carrying member. A M color image forming section 10M to form an image of a magenta (M) color comprises an electrically charging section 2M, an exposing section 3M, a developing section 4M and a cleaning section 5M which are arranged around a photoreceptor drum 1M being as an image carrying member. A C color image forming section 10C to form an image of a cyan (C) color comprises an electrically charging section 2C, an exposing section 3C, a developing section 4C and a cleaning section 5C which are arranged around a photoreceptor drum 1C being as an image carrying member. A K color image forming section 10K to form an image of a black (K) color comprises an electrically charging section 2K, an exposing section 3K, a developing section 4K and a cleaning section 5K which are arranged around a photoreceptor drum 1K being as an image carrying member. The electrically charging section 2Y and the exposing section 3Y, the electrically charging section 2M and the exposing section 3M, the electrically charging section 2C and exposing-section 3C, and the electrically charging section 2K and the exposing section 3K constitute a latent image forming section respectively.

Each of reference symbols 4Y, 4M, 4C, and 4K represents a developing device accommodating a two component developer which contains of small particle size toner of the corresponding one of yellow (Y), magenta (M), cyan (C), and black (K) and carrier.

A transfer section is constituted with a belt-shaped intermediate transfer member 6 which is wound around two or more rollers and is supported to be rotatable, a primary transfer section which has primary transfer sections 7Y, 7M, 7C, and 7K, and a secondary transfer section.

Each color toner image formed by the respective color image forming sections 10Y, 10M, 10C and 10K is transferred sequentially by the respective primary transfer sections 7Y, 7M, 7C, and 7K of the primary transfer section onto the intermediate transfer member 6 being rotating so that a synthesized color image is formed.

A recording medium (hereafter, referred to as a sheet) S being accommodated in a sheet storage section (sheet cassette) 21 of the sheet feeding apparatus 20 is fed out by a sheet feeding section (first sheet feeding section) 22, and the sheet S is conveyed through sheet feed rollers 23, 24, 25A, and 25B and a registration roller (second sheet feeding section) 26 to a secondary transfer section 9 of the secondary transfer section through grade, then a color image is transferred onto the sheet S. As mentioned above, a color image which consists of the mono color toner images is formed on a sheet by the image forming section 10.

Three-staged sheet storage sections 21 are arranged to be piled up vertically in the lower portion of the image forming apparatus A, and the sheet storage sections 21 have the almost same structure and are provided with the same reference symbol. Further, three-staged sheet feeding sections 22 also have the almost same structure and are provided with the same reference symbol. The sheet storage sections 21 are called together with the sheet feeding sections 22 a sheet feeding apparatus 20.

The sizes and kinds of sheets S being accommodated in the sheet storage sections 21 are indicated on a display screen of an operating section 11, and a size and a kind are optionally selected and set up. Moreover, it is also possible to set up a size of sheets S automatically in accordance with the size of documents and a copy magnification.

A sheet S on which a color toner image has been formed by the image forming section 10 is conveyed to the fixing device 30. In the fixing device 30, the actions of heat and pressure are applied onto the color toner image on the sheet S such that the color toner image (or toner image) is fixed on the sheet S.

The sheet S having been subjected to the fixing treatment is pinched and conveyed by paired conveying rollers 37, discharged to the outside of the apparatus by sheet discharging rollers 27 provided on a discharged-sheet conveying passage, and is placed on a discharged-sheet tray 28 at the outside of the apparatus.

On the other hand, after a color image is transferred from the intermediate transfer member 6 to a sheet S by the secondary transfer section 9 and the sheet is separated from the intermediate transfer member 6 by the curvature, residual toner on the intermediate transfer member 6 is removed by the cleaning section 8.

In the case where a sheet H having been subjected to the fixing treatment is inversed and discharged, the sheet S is made to pass a conveyance path at the right side, in the drawing, of a branch board 29 arranged at a branch point on an intermediate position between the fixing device 30 and the sheet discharging rollers 27, is conveyed to a lower conveyance path r1 (inversing conveyance path), and is inversed and conveyed. Then, the sheet S is made to pass a conveyance path r2 at the left side of the branch board 29 and discharged to the outside of the apparatus by the sheet discharging rollers 27.

In the above-mentioned explanation, the image forming apparatus A is made to form a color image. However, the scope of the present invention includes the case where the image forming apparatus A is made to form a monochrome image.

[Fixing Device]

Hereafter, the fixing device 30 of the image forming apparatus A will be explained.

Figure 2:
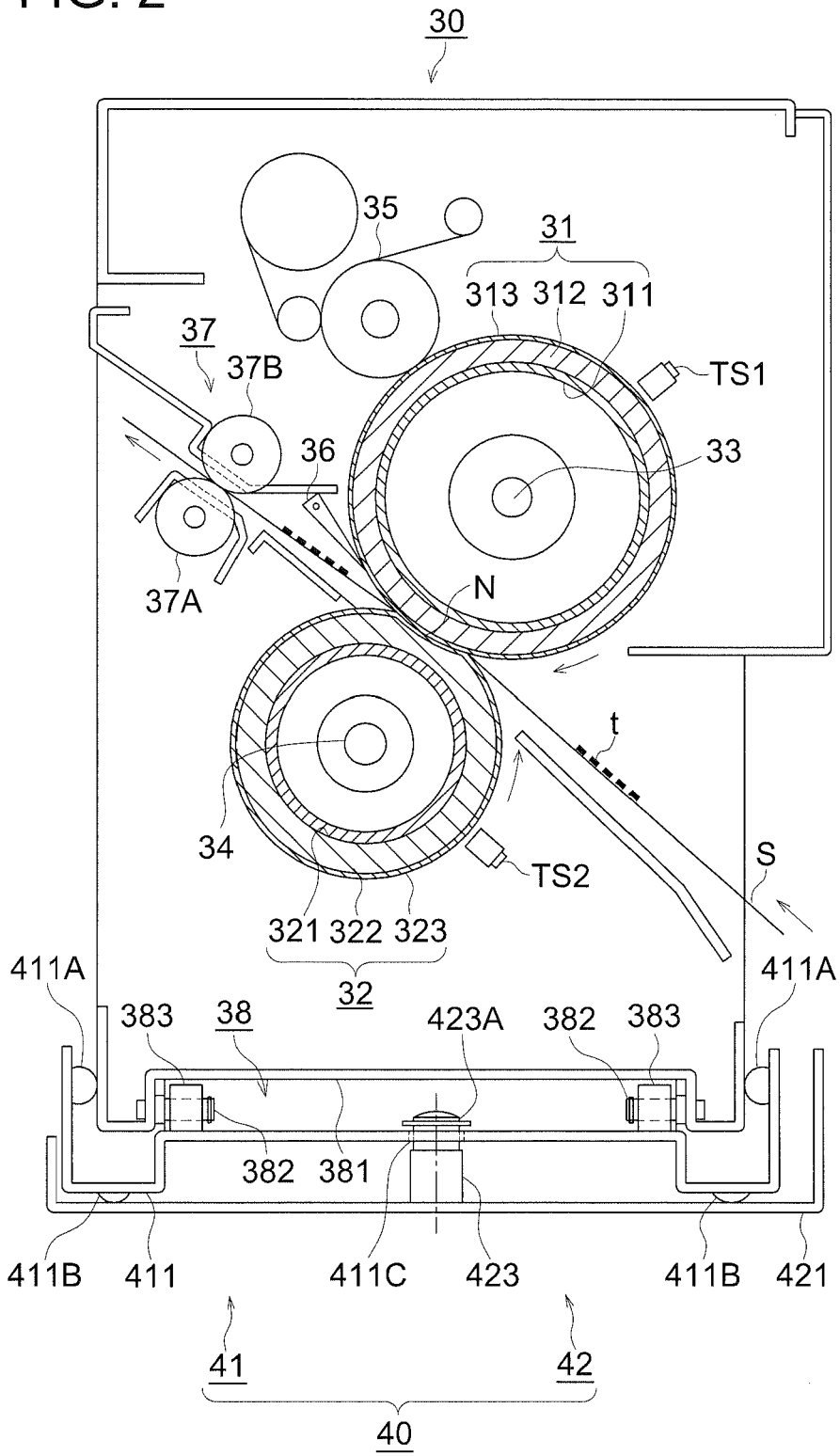
FIG. 2 is a cross sectional view showing an embodiment of a heating roller type fixing device 30 according to the present invention.

FIG. 2 is a cross sectional view showing an embodiment of the fixing device 30 of a heating roller type.

The fixing device 30 is supported by the apparatus trestle section 40 such that the fixing device 30 is able to oscillate in the width direction perpendicular to the sheet conveying direction.

The fixing device 30 comprises a fixing roller 31 and a pressing roller 32 as a pair of fixing members, a heat source 33 to heat the fixing roller 31, and a heat source 34 to heat a pressing roller 32.

The fixing roller 31 and the pressing roller 32 are made to come in contact with each other so as to form a nip portion N, and, as the heat sources 33 and 34, a halogen lamp, an induction heating section, etc. are used.

Around the periphery of the fixing roller 31, arranged are a cleaning roller 35, a temperature detecting section (temperature sensor) TS1, a thermostat for abnormal temperature prevention which is not shown in the drawing. Also, around the periphery of the pressing roller 32, arranged are a temperature detecting section (temperature sensor) TS2, a thermostat for abnormal temperature prevention and the like.

The fixing roller 31 is constituted by a core metal 311 as a heat conductive base member, an elastic layer 312, and a covering layer 313.

The temperature detecting section TS1 is adapted to detect the surface temperature of the fixing roller 31, and the surface temperature of the fixing roller 31 is controlled to be maintained at a prescribed temperature based on the detection signal of the temperature detecting section TS1. When a sheet S is introduced into the nip portion N, the sheet S receives the actions of heat and pressure at the nip portion. As a result, a toner image ton the sheet S is fixed onto the sheet S.

The fixing roller 31 is a cylindrical member with an outside diameter of 20 to 70 mm which is constituted by the heat conductive base member 311, the elastic layer 312, and the covering layer 313. As the cylindrical heat conductive base member 311, an aluminum material with good heat conductivity is mainly used, and a non magnetic stainless steel material, a thermally resistant glass, and the like may be used. The heat conductive base member 311 has a required mechanical strength and a thickness (wall thickness) of 0.8 to 10 mm.

The elastic layer 312 is formed, for example, by a synthetic rubber, such as a silicone rubber and a fluorine containing rubber. Further, in order to respond to a request to form an image with high speed, it is desirable to enhance heat conductivity by compounding powder of a metal oxide such as silica, alumina, and magnesium oxide, as filler in an amount of 5 to 30 weight % into the above synthetic rubber. The mixed filler has desirably a good conductivity like a conductive carbon black. With that, the electric resistance (volume resistivity) of the elastic layer 312 can be set to be low easily. The elastic layer 312 is made to have a thickness (wall thickness) of 0.3 to 3 mm, preferably 1 to 3 mm and a rubber hardness of 5 Hs to 30 Hs as JIS-A rubber hardness.

The pressing roller 32 is a lower side cylindrical member paired with the fixing roller 31 and is constituted by a heat conductive base member 321, an elastic layer 322, and a covering layer 323. The constituting members of the pressing roller 32 are formed with the almost same material, characteristics and dimension as those of the fixing roller 31.

For example, the heat conductive base member 321 is a steel pipe (STKM) with a wall thickness of 1 to 3 mm. The elastic layer 322 is formed around the peripheral surface of the heat conductive base member 321 and is a silicon rubber layer, a fluorine-containing rubber layer, or a sponge-like rubber layer employing a foam material of silicone rubber, and the elastic layer 322 is made to have a thickness (wall thickness) of 0.3 to 5 mm and a rubber hardness of 30 Hs to 70 Hs as JIS-A rubber hardness. The covering layer 323 is a heat resistant resin tube, such as PFA, PTFA, which is covered around the outside (peripheral surface) of the elastic layer 322 and has a mold release characteristic. The pressing roller 32 has an outside diameter of about 30 to 70 mm.

The pressing roller 32 is supported rotatably at a fixed position and is brought in pressure contact with the fixing roller 31 provided at the upper side by the urging force of a spring, whereby a flat-shaped nip portion N is formed between the fixing roller 31 and the pressing roller 32.

A sheet S which has passed through the nip portion N is separated from the peripheral surfaces of the fixing roller 31 and the pressing roller 32 and moves to the paired conveying rollers 37. A separating claw 36 located at the downstream side of the nip portion N guides smoothly the sheet S separated from the fixing roller 31 to the paired conveying rollers 37.

A roller supporting section 38 is adapted to support in an integrated manner the fixing roller 31 and the pressing roller 32 coming in pressure contact with the fixing roller so as to form a nip portion N, and serves as a case body 381 of the fixing device 30.

<Apparatus Trestle Section>

The apparatus trestle section 40 comprises an oscillating section 41 and an inclining section 42, is fixed on the main body of the image forming apparatus A, and supports the fixing device 30 mounted in the main body of the image forming apparatus A.

<Oscillating Section>

The fixing device 30 dismountable from the image forming apparatus A has four support spindles 382 which are fixed to the lower side of the ease body 381 respectively in such a way that tow support spindles 382 are located at a front side and other tow support spindles 382 are located at the rear side, and a roller 383 is attached rotatably to each of the support spindles 382.

The rollers 383 attached to the support spindles 382 provided on the case body 381 are placed on a trestle member 411 of the apparatus trestle section 40, and the position, in the sheet longitudinal direction, of the case body 381 is regulated by the regulating section 411A of the trestle member 411, whereby the fixing device 30 is supported to be movable in the sheet width direction. In other words, the fixing roller 31 and the pressing roller 32 are movable in the sheet width direction on the apparatus trestle section 40.

Figure 3:
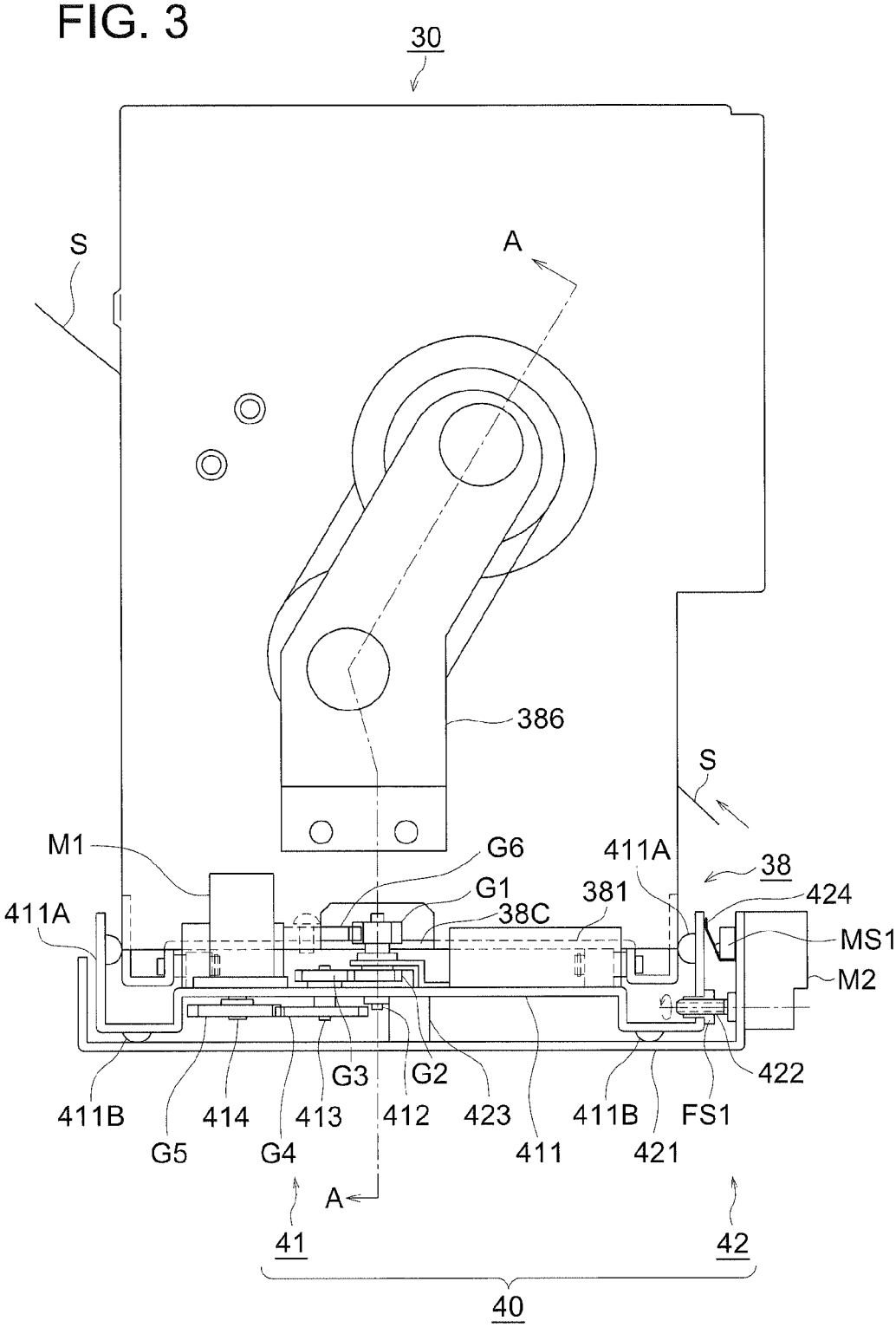
FIG. 3 is a front view of the fixing device 30 and an apparatus trestle section 40.

FIG. 3 is a front view of the fixing device 30 and the apparatus trestle section 40, and shows an oscillating section to oscillate in the sheet width direction the fixing device 30 which supports the fixing roller 31 and the pressing roller 32 and an inclining section to incline the fixing device 30 to the sheet width direction. The oscillating section and the inclining section will be explained in detail later.

Figure 4:
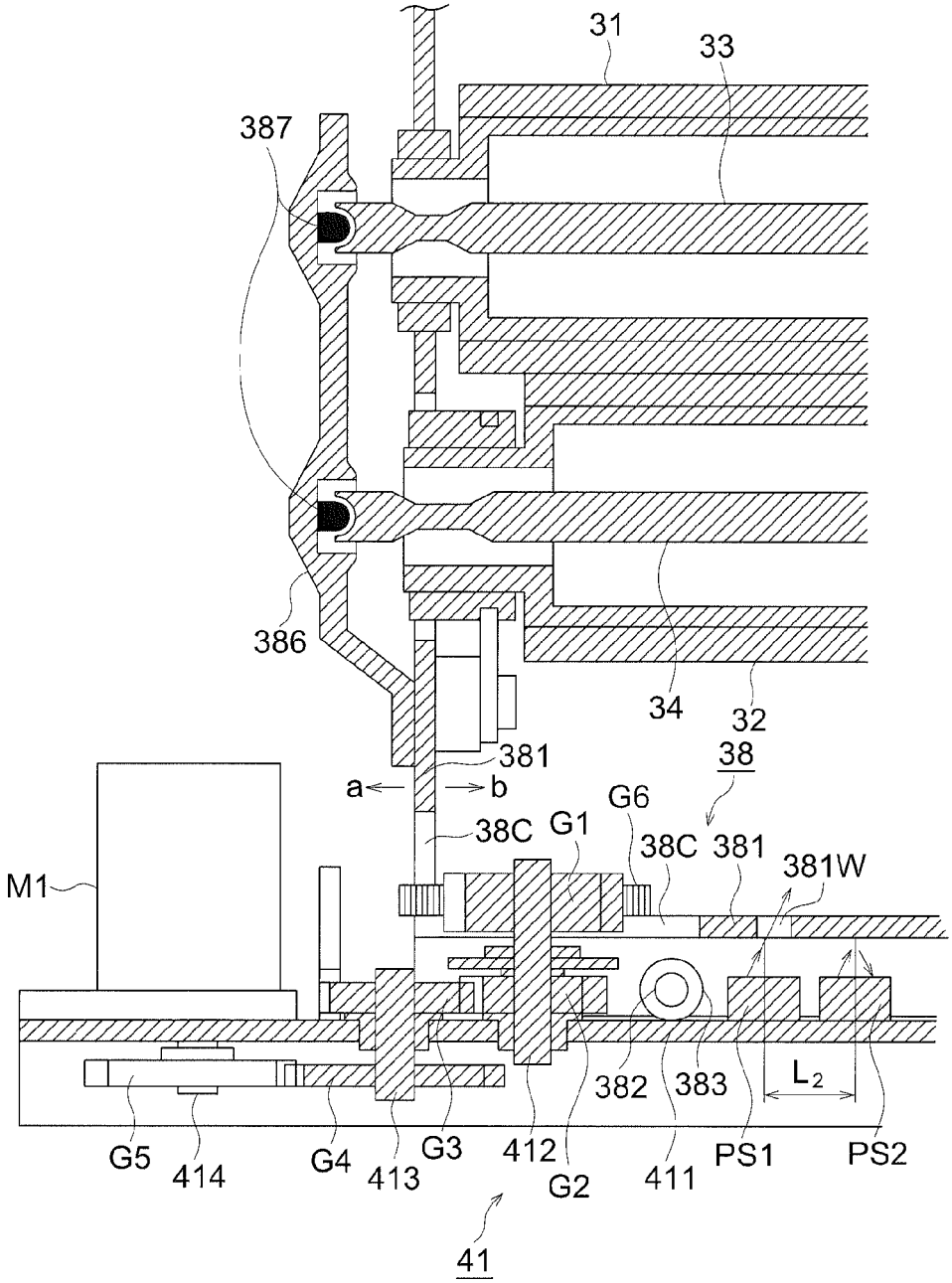
FIG. 4 is an enlarged sectional view of a roller supporting section 38 of the fixing device 30 and an oscillating section 41.

FIG. 4 is an enlarged sectional view of a roller supporting section 38 of the fixing device 30 and an oscillating section 41.

As shown in FIG. 3 and FIG. 4, an A rotation shaft 412, a B rotation shaft 413, and a C rotation shaft 414 are supported vertically and rotatably by bearings fixed to the trestle member 411.

An A gear G1 and a B gear G2 The are mounted on the A rotation shaft 412, and a C gear G3 and a D gear G4 are mounted on the B rotation shaft 413. The C rotation shaft 414 is a driving shaft of an oscillation motor M1 which is fixed to the trestle member 411, and an E gear G5 is mounted on the C rotation shaft 414.

The drive linkage is structured such that the B gear G2 engages the C gear G3 and the D gear G4 engages the E gear G5, whereby the A gear G1 is rotated by the driving of the oscillation motor M1.

A line gear G6 is structured such a configuration that a plane gear is developed in the width direction, and the line gear G6 is fixed to a cut-out portion 38C on the bottom portion of the case body 381 (refer to FIG. 5) and is made to engage the A gear G1 of the oscillating section 41.

Figure 5:
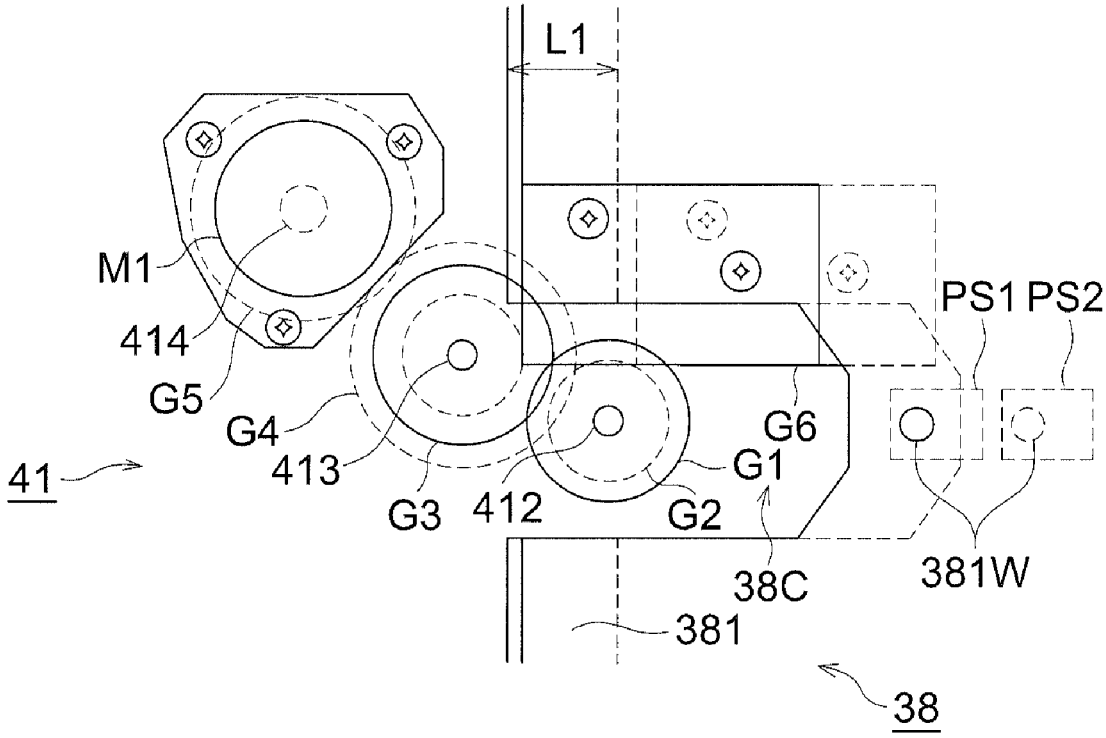
FIG. 5 is a plan view showing the condition of the engagement between an A gear of the oscillating section 41 and a line gear.

FIG. 5 is a schematic diagram (plan view) showing an engagement condition between the A gear G1 and the line gear G6 in the oscillating section.

The broken line in FIG. 5 shows the condition of the line gear G6 and the case body 381 which is displaced to the rear most side, and the solid line shows the condition of the case body 381 which is displaced to the front most side. L1 represents an oscillation width (a distance from the front most side to the rear most side) on which the case body 381 of the fixing device 30, i.e., the fixing roller 31 and the pressing roller 32 oscillate.

The case body 381 as a roller supporting section 38 can be oscillated by the driving of an oscillating motor M1 in the range of the oscillation width L1 in the width direction as shown with the arrow mark "a" or the arrow mark "b" in FIG. 4. In other words, the fixing roller 31 and the pressing roller 32 as a pair of fixing members supported integrally by the case body 381 can be oscillated by the driving of an oscillating motor M1 in the range of the oscillation width L1 in the width direction. On other hand, a sheet S is conveyed on a predetermined position in the width direction of the image forming apparatus A.

Therefore, since the positions of sheets S conveyed repeatedly are changed in the range of the oscillation width L1, the abrasion of the fixing roller caused by the side edge portions of the sheets S can be dispersed without concentrating at one position. Accordingly, the service life of the fixing roller as a pair of fixing members can be made longer.

A first1 position sensor PS1 shown in drawing is a detecting section to detect whether the case body 381 has moved up to the front most side, and a second position sensor PS2 is a detecting section to detect whether the case body 381 has moved up to the rear most side. When a detection hole 381W provided on the bottom portion of the case body 381 arrives at each detection position of the first position sensor PS1 and the second position sensor PS2, they change a detection signal from ON to OFF. L2 is substantially equal to the oscillation width L1 and represents a distance between the detection position of the first position sensor PS1 and the detection position of the second position sensor PS2.

As shown in FIGS. 2 and 4, the heat source 33 (34) is supported by a pair of heat source supporting members 386 (the rear side one is not shown) which are fixed with screws to the case body 381 of the fixing device 30.

In the heat source supporting members 386, lead wires being not shown in the drawing and convex-shaped terminals 387 coming in contact with concave-shaped terminal of the heat sources are provided so that an electric power is supplied to the heat source 33 and the heat source 34.

The temperature distribution on the fixing roller 31 is mainly determined on the basis of the distribution of heat supplied to each portion of the fixing roller 31 from each portion of the heat source and the distribution of heat taken out from the each portion of the fixing roller 31 by sheets S at the nip portion N. Therefore, the distribution of discharging heat of the heat sources supplied from the heat source 33 to the fixing roller 31 is determined after investigation has been made earnestly.

Figure 7:
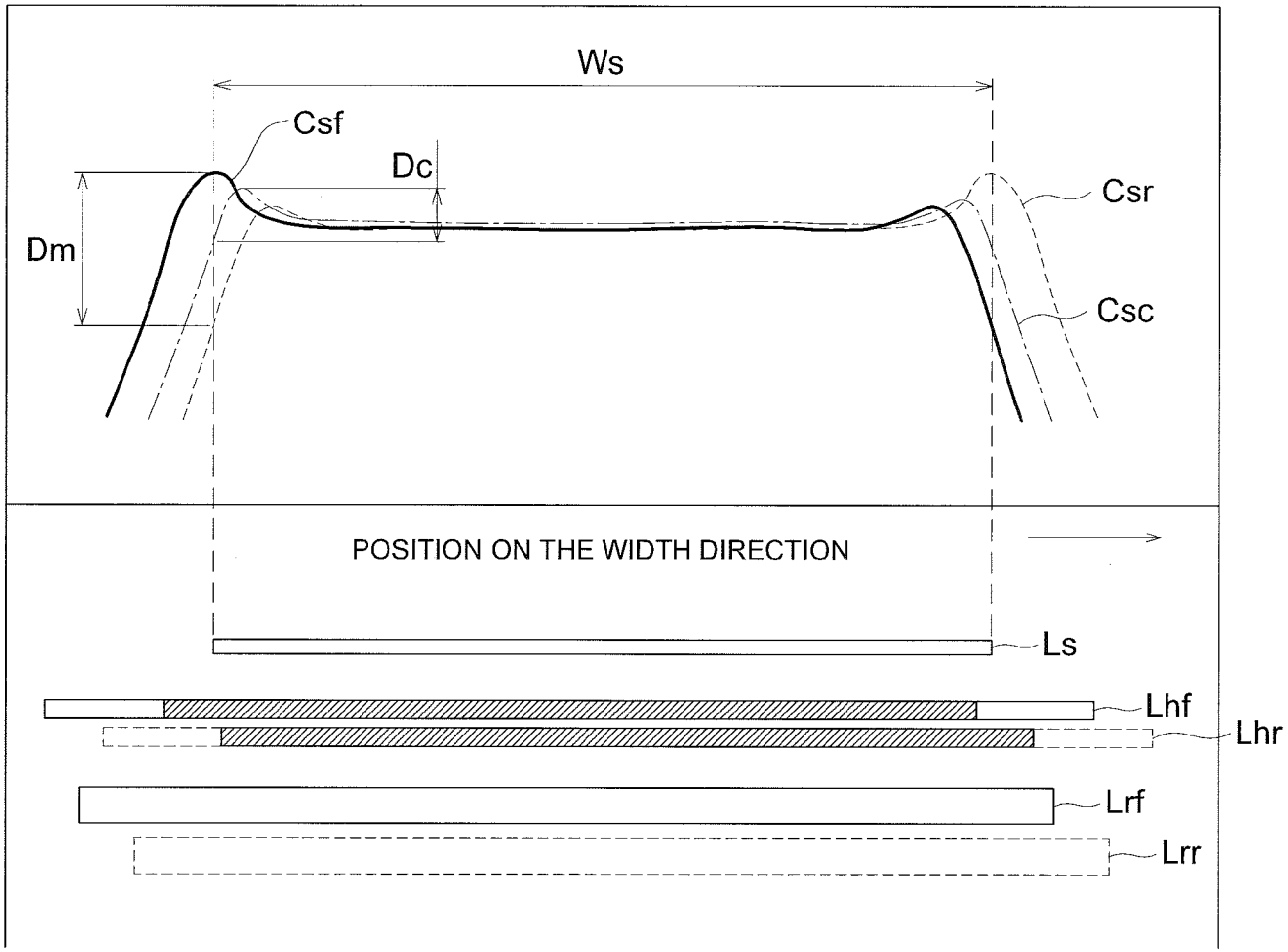
FIG. 7 is a graph showing a temperature distribution of the fixing roller 3 at the time of oscillating a fixing roller 3 by the oscillating section 41.

The upper portion of FIG. 7 is a graph which shows the temperature distribution on a sheet S in the case where the fixing roller 31 is oscillated by the oscillating section 41. The lower portion of FIG. 7 is an outline view showing a position Ls on which a sheet S locates, a position Lh on which the heat source 33 locates, a position Lr on which the fixing roller 31 locates, and a positional relationship among them.

Ls represents the position of the width direction on which a sheet S locates. Lrf and Lrr represent respectively the position of the width direction on which the fixing roller 31 locates. The solid line Lrf represents the position on which the fixing roller 31 locates when the fixing roller 31 has oscillated to the front most side, and the broken line Lrr represents the position on which the fixing roller 31 locates when the fixing roller 31 has oscillated to the rear most side.

Lhf and Lhr represent respectively the position of the width direction on which the heat source 33 locates. The solid line Lhf represents the position on which the heat source 33 locates when the fixing roller 31 has oscillated to the front most side, and the broken line Lhr represents the position on which the heat source 33 locates when the fixing roller 31 has oscillated to the rear most side. The oblique line portion of each of Lhf and Lhr shows a region where the heat source is substantially discharging heat to the fixing roller 31.

The axis of abscissa in FIG. 7 shows a relative position to the position of a sheet S in a width direction, and the axis of ordinate shows the temperature of the fixing roller 31 corresponding to the position of a sheet S.

Each of Csf and Csr is an example of a temperature distribution on the fixing roller 31 which was measured while sheets S were being conveyed continuously. The solid line Csf represents the temperature distribution on the fixing roller 31 which was measured when the fixing roller 31 has oscillated to the front most side, and the broken line Csr represents the temperature distribution on the fixing roller 31 which was measured when the fixing roller 31 has oscillated to the rear most side. A long dashed short dashed line Csc represents a temperature distribution on the fixing roller 31 which was measured when the fixing roller 31 was not oscillated.

Ws represents the width of a sheet S, and temperature deviation (difference between the maximum value, and the minimum value) of a fixing temperature on the width Ws of a sheet S is shown in such a way that Dc represents temperature deviation when the fixing roller 31 and the pressing roller 32 are not oscillated, and Dm represents temperature deviation when the fixing roller 31 and the like are oscillated.

The graph in FIG. 7 shows the following trends. If the oscillation speed is made slow, that is, if a time for a round trip on the oscillation distance L is made long, the abovementioned temperature deviation (temperature unevenness) increases. On the contrary, if the oscillation speed is made fast, that is, if a time for a round trip on the oscillation distance L is made short, the temperature deviation becomes small.

For example, in the case where the oscillation speed is 0.1 mm/sec, an oscillation time of 200 sec is required for a round trip on an oscillation distance L of 10 mm and paper sheets corresponding to 160 sheets are processed during the oscillation time. As a result, the temperature deviation on a sheet S increased to about 20° C. as compared with the case where the fixing roller was not oscillated, and problems such as fixing unevenness (failure) due to heating imbalance on portions of a sheet occurred.

On other hand, in the case where the oscillation speed is 0.5 mm/sec, an oscillation time is 40 sec and paper sheets of 32 sheets are processed during this period. As a result, the temperature deviation on a sheet S decreased to about 4° C. as compared with the case where the oscillation speed is 0.1 mm/sec, and problems such as fixing unevenness due to heating imbalance on portions of a sheet occurred were solved.

As mentioned above, if the oscillation speed is made slow, since deviation in the temperature distribution on a sheet S becomes large due to the oscillation of the fixing roller 31, problems in the fixing performance occur. Therefore, in the embodiment of the present invention, the lowest oscillation speed at which problems in the fixing performance do not occur is obtained, and the fixing roller 31 and the pressing roller 32 are oscillated at a speed higher than the lowest oscillation speed.

Further, if a sheet S becomes thicker, temperature deviation generated on a sheet S becomes large in spite of the same oscillation speed. Therefore, in order to suppress temperature deviation on a sheet S, the conditions of the oscillating section may be changed by a control section 101 mentioned later such that an oscillation speed may be increased in accordance with the thickness of a sheet.

For example, in the case of a regular paper (sheet with a weight below 220 g/m$^2$), the oscillation speed is set at 0.5 mm/sec, and, in the case of a thicker paper (sheet with a weight more than 220 g/m2), the oscillation speed is set at 1.0 mm/sec.

<Inclining Section>

Incidentally, if the fixing device 30 (that is, the fixing roller 31 and the pressing roller 32) is oscillated (shifted in one of width dictions) by the above-mentioned oscillating section, a sheet S pinched at the nip portion N is conveyed while being provided with one-sided shift toward a width direction (referred tentatively to as one-sided oscillation shift). Especially as shown in FIG. 1, in the case where a sheet is held by both the fixing device 30 (nip portion N in FIG. 2) and a secondary transfer section 14, since the one-sided oscillation shift takes place only at the fixing device 30 side, distortion arises on a sheet S located between the fixing device 30 and the secondary transfer section 9. Further, in the case where the oscillation speed becomes fast, the distortion of a sheet S becomes large, and then wrinkle and crease are caused on the sheet. For example, the sheet wrinkles and sheet crease which are not observed at an oscillation speed of about 0.1 mm/sec or less are caused at an oscillation speed of about 0.5 mm/sec.

An inclining section 42 of an apparatus trestle section 40 according to the present invention inclines a nip portion N to the width direction in parallel to a conveyance plane so that when a sheet passes through the nip portion N, the sheet is conveyed with a one-sided shift (referred tentatively to as one-sided inclination shift) toward the width direction opposite to the direction of the one-sided oscillation shift.

Next, an explanation is made for a relationship between an inclination angle DA at which the nip portion N intersects with the width direction of a sheet S and the conveying direction of the sheet S conveyed by the nip portion N.

Figure 8:
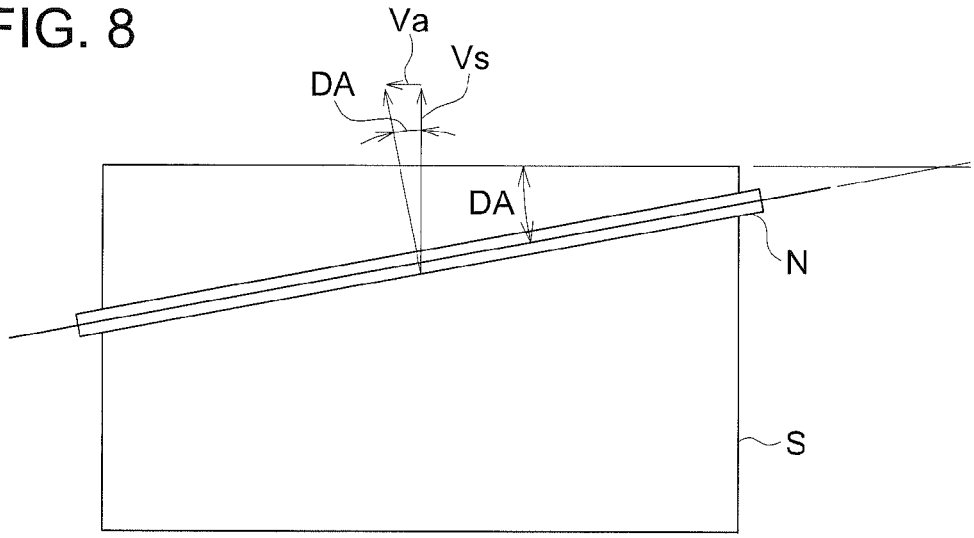
FIG. 8 is an outline view showing the components of the conveyance speed which a sheet S receives by the frictional force of a nip portion N which is inclined to the width direction.

FIG. 8 is an outline diagram showing components of a conveyance speed which a sheet S receives by the frictional force of the nip portion N.

Here, the nip portion N is made to intersect with the width direction of a sheet S at an inclination angle DA by the inclining section 42. Vs is a conveyance direction component of the conveyance speed of a sheet S by the nip portion N, and Va is a width direction component of the conveyance speed of the sheet S and is referred tentatively to a one-sided inclination shift speed of the sheet S. Since the conveyance speed at which a sheet S passes the fixing device 30 is Vs, the following Formula 1 is established between a shift speed of the sheet S in the width direction, i.e., the one-sided inclination shift speed Va and the inclination angle DA.

$$DA=\arctan(Va/Vs) \qquad \text{Formula 1}$$

A control section 101 mentioned below controls the oscillating section 41 and the inclining section 42 such that one-sided oscillation shift and one-sided inclination shift are made opposite to each other and are made to respective equivalent amounts not causing wrinkles on a sheet substantially.

If the one-sided inclination shift speed by the inclination of the nip portion N is −Va for the one-sided oscillation shift speed by the oscillating section 41, i.e., an oscillation speed Vn, the effective oscillation speed yen of a sheet S will is represented by the following Formula 2.

$$Ven=Vn-Va \qquad \text{Formula 2}$$

At the time of Ven=0, the oscillation speed Vn by the oscillating section 41 and the one-sided shift speed Va by the inclining section 42 are thoroughly get balanced out (cancel each other thoroughly), whereby the distortion of a sheet S held between the fixing device 30 and the secondary transfer section 9 is canceled thoroughly. That is, even if a sheet S is shifted at the oscillation speed Vn of 0.5 mm/sec or more together with the fixing roller 31 by the oscillating section 41, since the control section 101 controls an inclining motor M2 of the inclining section 42 such that an inclination angle α is set in accordance with the oscillation speed Vn, problems of sheet wrinkles and sheet crease can be solved.

At the time of Ven=0, the following Formula 3 is established from Formula 1 and Formula 2.

$$DA=\arctan(-Vn/Vs) \quad \text{Formula 3}$$

Herein, Ven does not necessarily need to be zero, the operating condition of the inclining section 42 may be set in such a way that distortion produced on a sheet surface located between the fixing device 30 and the secondary transfer section 9 is reduced to such an extent that sheet wrinkles and sheet crease do not take place. As a matter of practice, the operating conditions of the inclining section 42 are set up in consideration of concrete embodiments.

For example, in the case where the oscillation speed is 0.5 mm/sec for a regular paper (paper sheet with a weight of 220 g/m$^2$ or less), the inclination angle becomes 0.13, and in the case where the oscillation speed is 1.0 mm/sec for a thicker paper (paper sheet with a weight of 220 g/m$^2$ or more), the inclination angle becomes 0.26. Therefore, if the distance between the pivot point of a rotating shaft 423 and an internal screw (female screw) FS1 is 400 mm, an amount of displacement by which the front side of the trestle member 411 is displaced in a sheet conveyance direction by rotation of the inclining motor M2 becomes about 0.9 mm in the case where the oscillating speed is 0.5 mm/see, or about 1.8 mm in the case where the oscillating speed is 1.0 mm/sec.

Next, hereinafter, the structure of the inclining section 42 is explained in detail with reference to FIGS. 2 and 3.

The inclining section 42 rotates horizontally the trestle member 411 supporting the fixing device 30 around a pivot point at the rear side as a center so as to incline the nip portion N of the fixing device 30 to the width direction, thereby shifting a sheet in the width direction with the inclination of the nip portion N, that is, thereby forming one-sided shift in the conveyance of a sheet.

As shown in FIG. 2, the inclining section 42 comprises a supporting base 421 which is fixed to the main body of the image fanning apparatus A and supports the lower portion of the trestle member 411, and a rotating shaft 423 fixed in the inner part of the central portion of the supporting base 421. Into the head portion 423A of the rotating shaft 423, inserted is a hole 411C provided at the rear side of the central portion of the trestle member 411. The trestle member 411 in which the oscillating section 41 and the fixing device 30 are mounted is supported such that its front side can be rotated horizontally around a pivot point provided at the rear side.

Hereafter, an explanation will be made with reference to FIG. 3.

As shown in the right portion of FIG. 3, an inclining motor M2 to displace the front side of the fixing device 30 in the sheet conveyance direction is fixed to the supporting base 421 at the front side of the inclining section 42. An external screw (mail screw) is formed on an output shaft 422 of the inclining motor M2. The internal screw FS1 is fixed to the trestle member 411, and the external screw of the output shaft 422 of the inclining motor M2 is rotatably inserted into the internal screw FS1. Therefore, it is possible to displace the front side of the trestle member 411 arbitrarily to the upstream side of the sheet conveyance direction or the downstream side in accordance with the rotation of the inclining motor M2.

Further, the inclining motor M2 is constituted by a stepping motor and a speed reduction driving mechanism consisting of a group of gears and can change arbitrarily the inclination angle of the fixing device 30 to the width direction with a high degree of accuracy.

A micro switch MS1 fixed to the supporting base 421 is a detecting section to detect whether the displaced trestle member 411 is at a reference position in the sheet conveying direction. An operation piece 424 is pushed by a regulating section 411A of the trestle member 411 being displaced in the upstream side and operates the micro switch MS1. This operating point serves as the reference position of the trestle member 411, that is, a home position of the displaced trestle member 411. Here, the home position is a position where the front side of the trestle member 411 is displace to the upstream-most side.

As mentioned above, the inclination angle at which the nip portion N formed by the fixing roller 3 and the pressing roller 32 intersects with the width direction can be arbitrarily set up by the pulse drive of the inclining motor M2.

[Control Block Structure]

Figure 6:
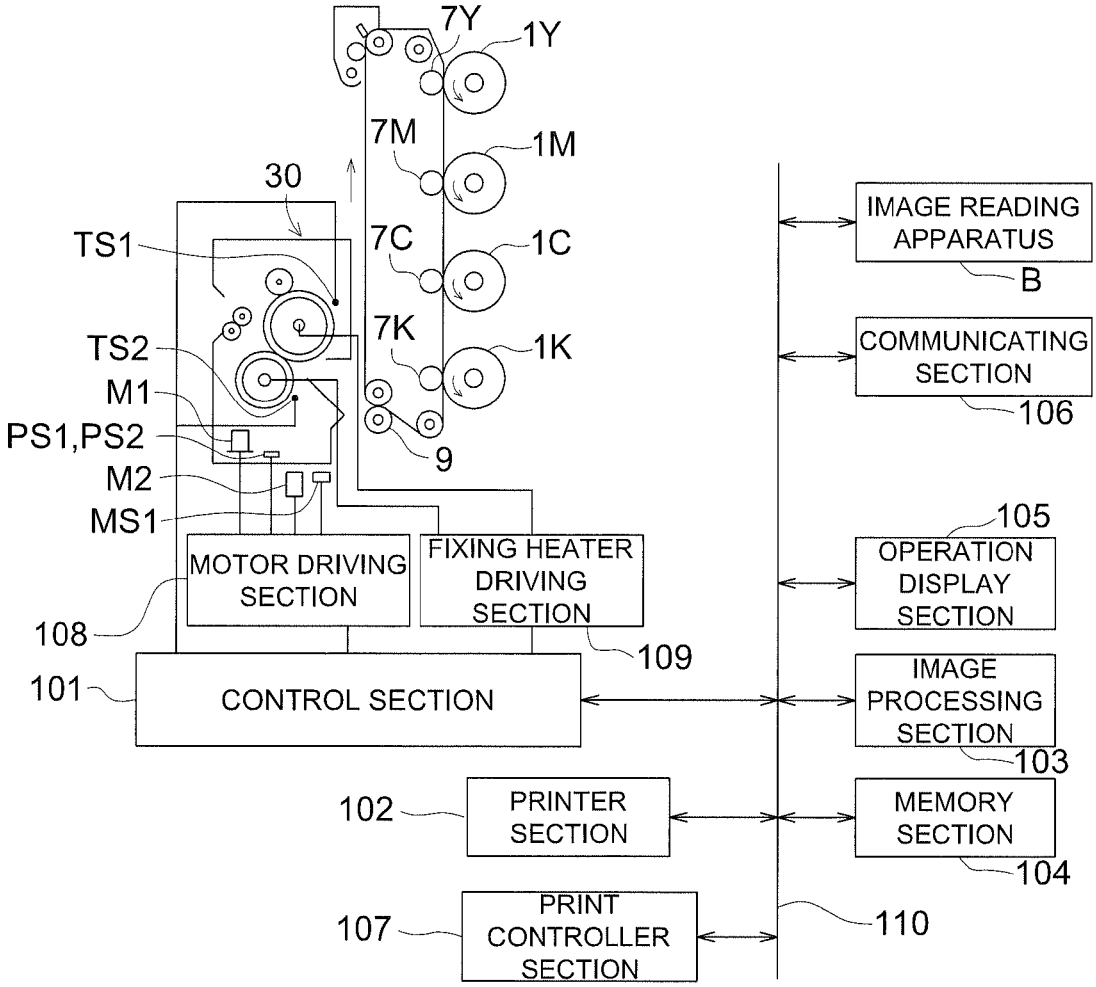
FIG. 6 is a control block diagram of the image forming apparatus A.

FIG. 6 is a control block diagram of the image forming apparatus A.

The control relationship of the image forming apparatus A is constituted by the control section 101, a printer section 102, an image processing section 103, an operation display section 105, a memory part 104, a communicating section 106, a print control section 107 and the like. Each section is connected to other sections by a bus 110. Further, each section communicates also through the bus 110 with an image reading device B mounted on the upper part of the image forming apparatus A.

The control section 101 is constituted by CPU, ROM, RAM and the like. By operations at the operation display section 105, the CPU of the control section 101 reads out system programs and various processing programs memorized in the ROM, expands them to the RAM, and conducts a centralized control for operations of each section of the image forming apparatus A in accordance with the expanded programs.

The operation display section 105 is constituted by LCD (Liquid Crystal Display), and displays the status of each of various operation buttons and devices and the operational situation of each function on a display screen in accordance with instructions of display signals inputted from the control section 101. Further, the operation display section 105 is provided with various operation buttons, such as numeral buttons and start buttons and outputs operation signals by button operations to the control section 101.

The image reading device B reads a document as analog signals of R, G and B, converts the analog signals into digital signals with an A-D converter and generates image data of R, G and B. Thereafter, the image reading device B outputs the image data to an image processing section 103 of the image forming apparatus A via a bus.

The image processing section 103 converts the image data of R, G, and B inputted from the image reading device B to image data of Y, M, C and k colors which can be processed by a print engine section 101. Furthermore, the image processing section 103 conducts γ correction processing in accordance with the output characteristics of the print engine section 101, or conducts binarization processing, such as error diffusion method, and produces printing data of Y, M, C and K colors. Then, the image processing section 103*a* outputs the printing data to the print engine section 101.

The communicating section 106 receives a print job from a personal computer on a network and transmits the received print job to the print control section 107. The print job consists of processing information with regard to printing processing and printing data (file).

The print control section 107 generates printing data of image data of Y, M, C and K colors based on the content of the print job and outputs the printing data with the corresponding processing information to the print engine section 101.

The print engine section 101 expands the image data inputted from the image processing section 103 and the print control section 107 on an image memory, scans sequentially image forming sections 10Y, 10M, 10C and 10K based on the image data so as to form images and transfers these images onto an intermediate transfer member so as to form a color image. Thereafter, the color image on the intermediate transfer member is transferred onto a sheet, and the sheet is subjected to a fixing treatment by the fixing device 30 and is outputted from the image forming apparatus A.

The control section 101 controls a fixing heat driving section 109 based on the temperature detected by temperature detecting sections TS1 and TS2 so as to make the heat sources 33 and 340N and OFF, whereby the temperature of each of the fixing roller 3 and the pressing roller 32 of the fixing device 30 is controlled to a prescribed temperature.

<Control of an Oscillation Speed Vn of a Fixing Device and an Inclination Angle DA of a Nip Portion According to the Present Invention>

The motor driving section 108 comprises a circuit to drive an oscillating motor M1 at a predetermined speed in order to shift a fixing roller as a pair of fixing members at a predetermined speed in the width direction, a circuit to drive an output shaft 422 of the inclining motor M2 in order to set the inclination angle DA of a nip portion N to the width direction to a specified value, and an input circuit into which the signals of the first position sensor PS1 and the second position sensor PS2 and the signal of the micro switch MS1 are inputted.

Based on processing programs memorized in the ROM, the control section 101 controls the oscillating section 41 and the inclining section 42 (driving of the inclining motor M2) in such a way that the oscillation speed of a sheet S provided by the oscillation of the fixing roller 3 and the one-sided shift speed of the sheet S provided by the inclination of the nip portion N are made opposite in direction to each other so as to cancel each other. As a result, in spite of oscillation of the fixing roller 3 at a high oscillation speed, the effective oscillation speed Ven of a sheet S is reduced greatly, whereby problems, such as sheet wrinkle, are solved.

For example, the control section 101 controls to drive the oscillating motor M1 so as to oscillate the fixing roller 3 in the width direction with a predetermined oscillation speed profile and also to drive the inclining motor M2 in accordance with the oscillation speed so as to form an inclination angle DA of the nip portion N.

Alternatively, the control section 101 controls to drive the inclining motor M2 of the inclining section 42 based on predetermined processing programs so as to change an inclination angle DA of the nip portion N with a predetermined angle profile and also to drive the oscillating motor M1 so as to change the oscillation speed (oscillation direction) of the fixing roller 3 in accordance with the inclination angle DA of the nip portion N.

Alternatively, based on processing programs memorizing an oscillation driving profile to drive the oscillating motor M1 and an inclination driving profile to drive the inclining motor M2 which are made to correspond to each other, the control section 101 controls to drive the oscillating motor M1 and the inclining motor M2 in such a way that the one-sided oscillation shift speed caused by the oscillation of the fixing roller 3 and the one-sided inclination shift speed caused by the inclination of the nip portion N are made opposite in direction to each other so as to cancel each other.

The image forming apparatus A according to the present invention makes the fixing roller 3 and the pressing roller 32 to oscillate in the width direction for a sheet S so as to prevent local repetition abrasion to the fixing roller 3 by edge portions of a sheet, whereby the longer service life of the fixing roller 3 can be realized. Further, the oscillation speed is made faster so as to maintain the heat balance supplied to each portion of a sheet in good order, whereby the image forming apparatus A has an excellent fixing performance without fixing unevenness and fixing failures. Furthermore, the nip inclination angle is changed in accordance with the oscillation speed so as to cancel one-sided oscillation shift of a sheet in the width direction with one-sided inclination shift of the sheet provided by the inclination of the nip portion, whereby the image forming apparatus A has a stable sheet conveying performance without sheet wrinkle and sheet crease.

Figure 9:
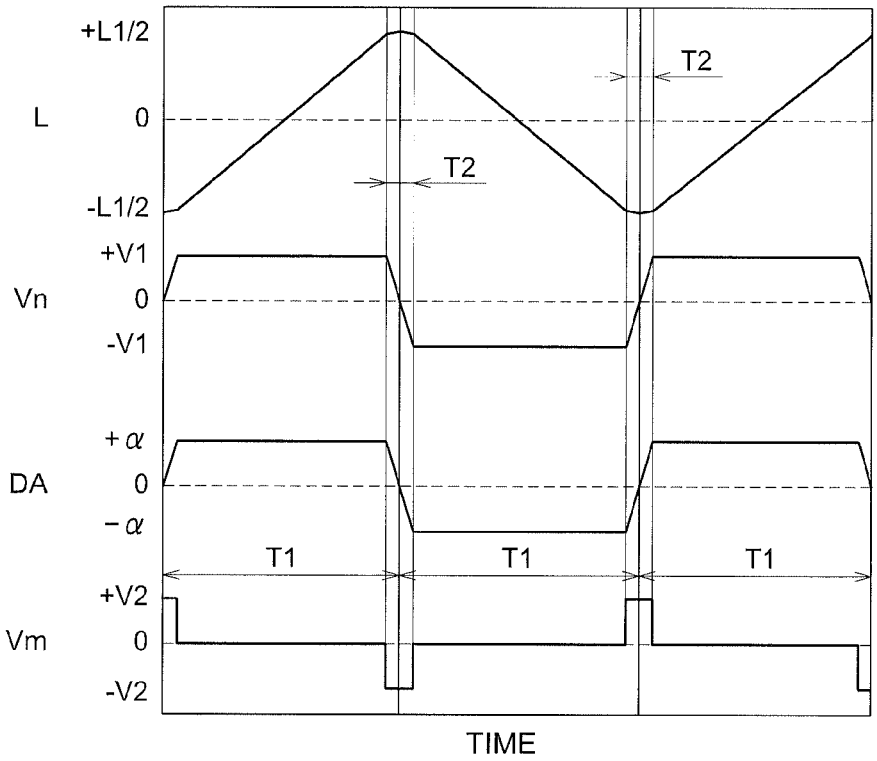
FIG. 9 is a timing sequence in the drive control of the oscillating section and an inclining section according to the present invention.

FIG. 9 shows a timing sequence with regard to the drive control of the oscillating section and the inclining section. An axis of abscissa indicates time. An axis of ordinate indicates the oscillation position L of the fixing device 30, the oscillation speed Vn of the fixing device 30, the inclination angle DA of the fixing device 30 (nip portion N) to the width direction and the rotation speed Vm of the inclining motor M2.

The control section 101 makes the oscillating motor M1 conduct normal rotation and reverse rotation alternately repeatedly with a cycle of T1 so that the fixing roller 31 and the pressing roller 32, i.e., the fixing device 30 is made to oscillate within a range of L1.

L shown in FIG. 9 represents the oscillation position of the fixing roller 31 oscillated by the driving of the oscillating motor M1 and changes in a range from −L1/2 to +L1/2. Further, a plus sign shown in the drawing indicates the oscillation position in the rear side (the rear side on the sheet of FIG. 1) in relation to the reference position, and a minus sign indicates the oscillation position in the front side.

Vn shown in FIG. 9 represents the oscillation speed of the fixing roller 31 oscillated by the driving of the oscillating motor M1, the fixing roller 31 moves toward the rear side with the oscillating speed of +Vn1 as shown in the drawing and moves toward the front side with the oscillating speed of −Vn1.

As shown in the profile of the oscillating speed Vn in FIG. 9, the control section 101 controls the driving of the oscillating motor M1 so as to switch over the direction of the oscillation continuously during the time of T2. During the switching-over time of T2, since the oscillating speed Vn becomes lower than V1, a short time is suitably chosen as T2 such an extent that fixing unevenness due to temperature unevenness on temperature distribution on a sheet does not take place.

DA shown in FIG. 9 represents an inclination angle at which the nip portion N of the fixing device 30 intersects with the width direction and is changed in a range from +α to −α by the driving of the inclining motor M2. Thus, DA changes with a profile shown in the drawing in accordance with the profile of Vn. The plus sign (+) indicates that the direction (orientation) of the inclination one-side shift is toward the front side, and the minus sign (−) indicates that the direction (orientation) of the inclination one-side shift is toward the rear side.

Vm shown in FIG. 9 represents the rotation speed of the output shaft 422 of the inclining motor M2. The amount of rotation of the output shaft 422 which is the time integration of this rotation speed, corresponds to the inclination angle DA, and Vm indicates a profile shown in the drawing.

When the oscillating speed is switched over continuously as shown in the embodiment of FIG. 9, it becomes possible also to make a sheet S to pass through the nip portion at the time of switching over the direction of oscillation and the direction of inclination, whereby the present invention has the feature that it makes possible to maintain the high sheet processing capability of the image forming apparatus A.

The control section 101 may control the driving of each of the oscillating motor M1 and the inclining motor M2 based on the signals of the first position sensor PS1 and the second position sensor PS2 such that the rotation direction of the oscillating motor M1 is switched over from +V1 to −V1, or vice versa, and the inclination angle DA of the fixing device 30 is switched over from +α to −α, or vice versa.

Figure 10:
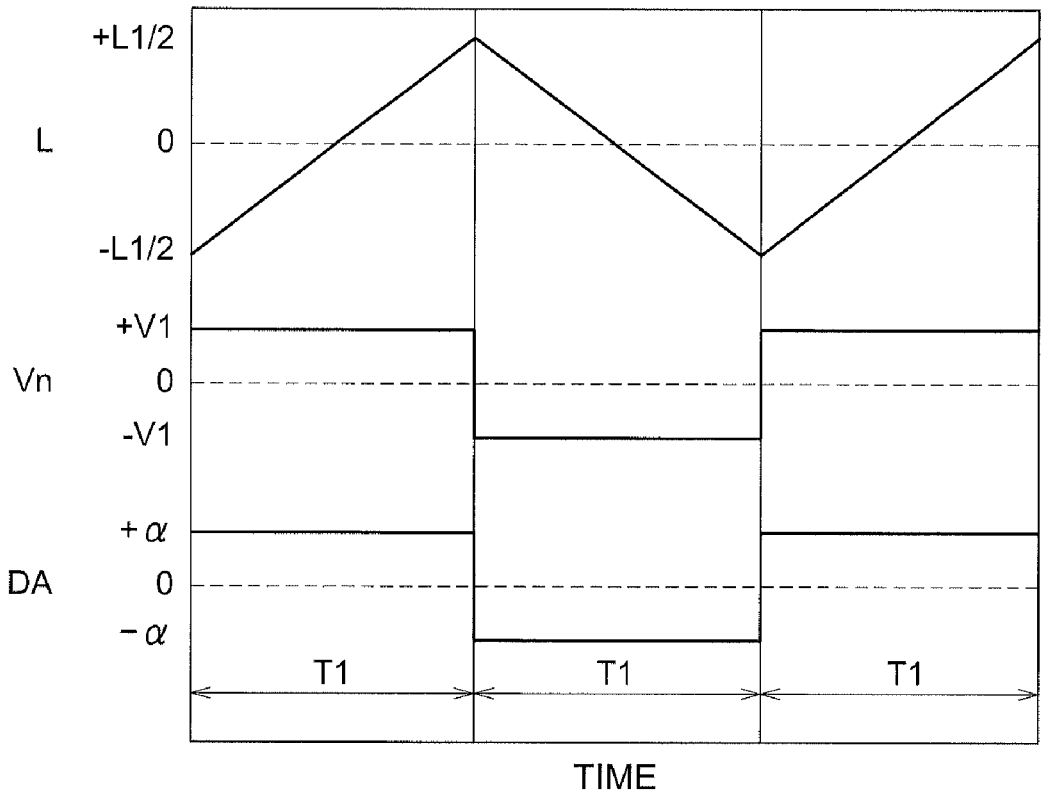
FIG. 10 is a timing sequence in another embodiment according to the present invention.

FIG. 10 shows a timing sequence in another embodiment according to the present invention in which the direction of the oscillation speed and the direction of the inclination angle of the fixing device 30 are switched over instantly. The timing sequence shown in FIG. 10 is different from that shown in FIG. 9 in the point that the switching-over time T2 does not exist.

In this embodiment, in order to make the timing to switch over the direction of oscillation and the direction of inclination not to overlap with the time when a sheet passes through the nip portion, employed is a complicate processing program to postpone the timing when a sheet passes through the nip portion or the timing to switch over the direction of oscillation, whereby it makes possible to maintain the high sheet processing capability of the image forming apparatus A.

Herein, an image forming apparatus according to the embodiment of the present invention and locating within the object of the present invention includes the structure that an oscillating section is constituted by a mechanical mechanism to oscillate a fixing device 30 with a predetermined oscillation speed profile and the control section controls an inclining section to adjust an inclination angle of the fixing device 30 (nip portion N) to the width direction in accordance with the oscillation speed of the fixing device 30 by the oscillating section.

Further, an image forming apparatus according to the embodiment of the present invention and locating within the object of the present invention includes the structure that an inclining section is constituted by a mechanical mechanism to change an inclination angle of a nip portion N with a predetermined profile and the control section controls an oscillating section to adjust an oscillation speed of the fixing device 30 in the width direction in accordance with the change of the inclination angle of the nip portion by the inclining section.

In the abovementioned oscillation control, the oscillation position of each of the fixing roller 3 and the pressing roller 32 is displaced in accordance with the operation time of the fixing device 30 or the image forming apparatus A. However, the oscillation position of each of the fixing roller 3 and the pressing roller 32 may be displaced in accordance with the number of processed sheets S or the length of processed sheets S.

In the abovementioned embodiment according to the present invention, the apparatus trestle section 40 having the oscillating section 41 and the inclining section 42 is fixed to the image forming apparatus A and the fixing device 30 is mounted on the apparatus trestle section 40 fixed to the image forming apparatus A. Since the number of components in an exchanging unit becomes few, the above structure is excellent in terms of cost.

In the embodiment according to the present invention, the apparatus trestle section 40 having the oscillating section 41 and the inclining section 42 may be made in a single body together with the fixing device 30 and installed in the image forming apparatus A.

In the abovementioned embodiment according to the present invention, the roller supporting section 38 supporting the fixing roller and the pressing roller is the case body 381 of the fixing device 30, and the case body 381 is made to be able to oscillate in the width direction.

Alternatively, the roller supporting section 38 is made in a different body separately from the case body 381 of the fixing device, and the roller supporting section 38 is made to be able to oscillate in the width direction for the case body 381. This embodiment is made within the scope of the present invention.

Further, in the abovementioned embodiment according to the present invention, the fixing roller 3 and the pressing roller 32 are used as a pair of fixing members. However, the present invention is not limited to this embodiment. For example, at least one of the pair of fixing members may be replaced with an endless belt which is arranged to be rotatable.

Figure 11A:
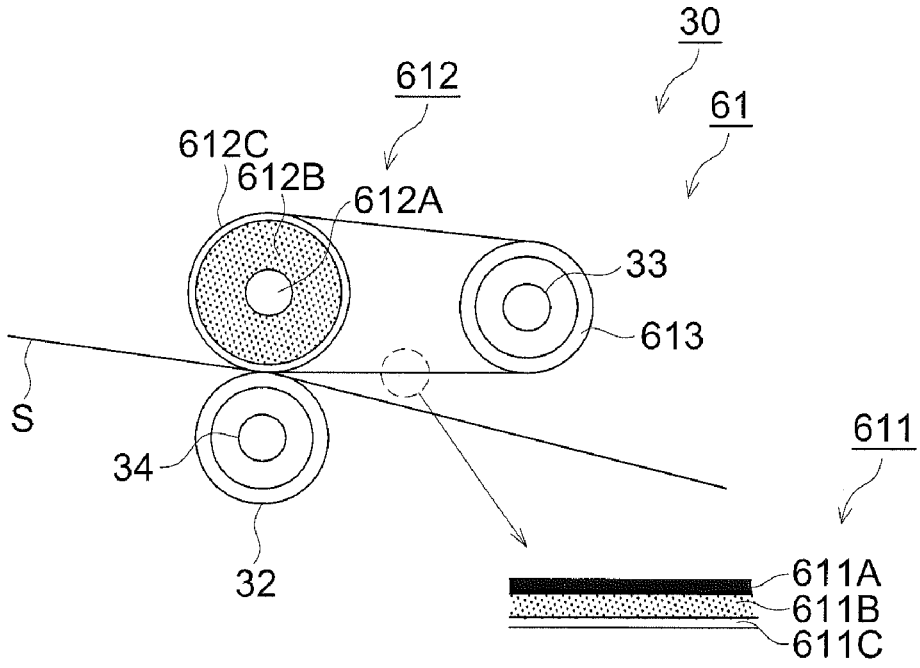
FIGS. 11*a* and 11*b* each is a schematic diagram showing an example of a fixing-belt type fixing device in which at least one of a pair of fixing members is made to a heat-resistant endless belt which is arranged to be rotatable.
Figure 11B:
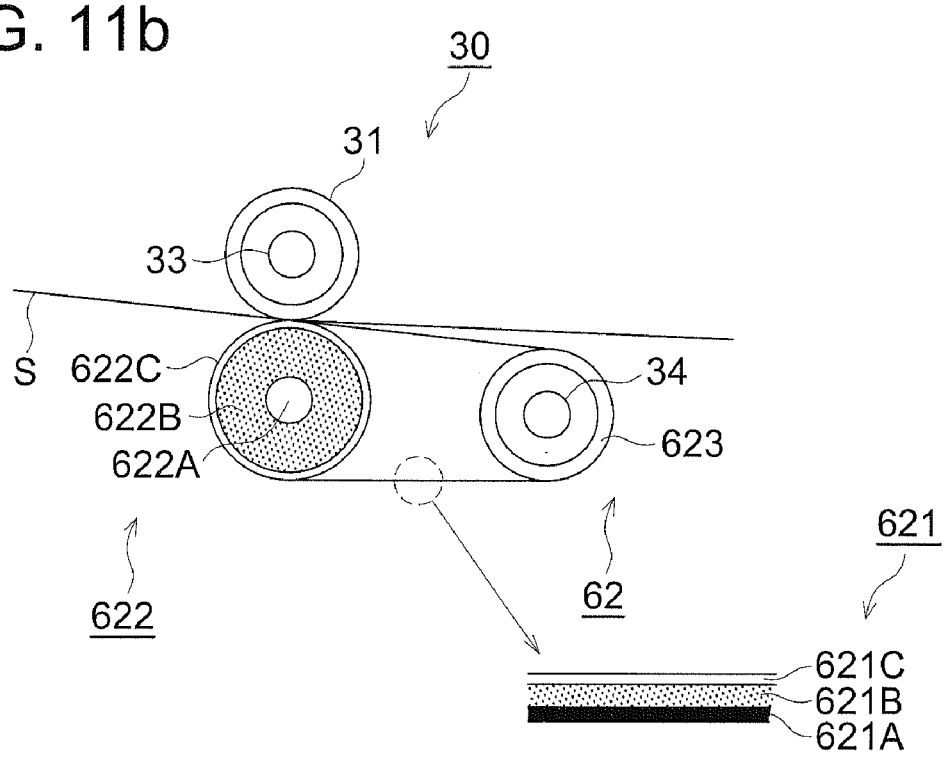

FIG. 11 is a schematic diagram showing an example of a belt type fixing device in which at least one of a pair of fixing members is made to a heat-resistant endless belt which is arranged to be rotatable.

FIG. 11(*a*) shows an embodiment in which one of a pair of fixing members is a fixing belt 611 which is brought in pressure contact with a pressing roller 32.

A fixing belt section 61 is constituted by an elastic roller 612 brought in pressure contact with the pressing roller 32, a heating roller 613 to heat the fixing belt 611, and the fixing belt 611 wound around both of the heating roller 613 and the elastic roller. The fixing belt 611 is made rotatable in the arrow direction by the driving of one of the heating roller 613 and the elastic roller 612.

As shown in an enlarged view, the fixing belt 611 comprises a heat-resistant endless belt 611A made of such as polyimide resin, a heat-resistant elastic layer 611B made of such as a silicon rubber covered on the heat-resistant endless belt 611A, and an outermost layers 611C made of such as PFA formed on the heat resistant elastic layer 611B.

The elastic roller 612 is constituted by a roller shaft 612A being a core metal, a heat resistant elastic layer 612B made of a foaming silicon rubber covered on the core metal of the roller shaft 612A, and a surface layer 612C made of a silicon rubber with higher hardness as compared with the heat resistant elastic layer 612B. There is no heat source in the inside of the elastic roller 612, and a heat source 33 to heat the fixing belt is provided in the inside of the heating roller 613.

Another side of the pair of fixing members is a pressing roller 32, and since the pressing roller 32 is similar to the pressing roller 32 of the fixing device shown in FIG. 2, an explanation for it is omitted.

The fixing belt 611 heated with the heating roller 613 comes in pressure contact with a conveyed sheet S at a nip portion formed between the pressing roller 32 and the elastic roller 612 which are brought in pressure contact with each other.

The sheet S conveyed from the image forming section is guided to the nip portion, and a toner image is fixed on the sheet S with the action of heat and pressure.

FIG. 11(*b*) shows an embodiment in which one of a pair of fixing members is a pressing belt 621 which is brought in pressure contact with a fixing roller 31. Since the fixing roller 31 is similar to the fixing roller 31 of the fixing device shown in FIG. 2, an explanation for it is omitted.

A pressing belt section 62 is constituted by an elastic roller 622 brought in pressure contact with the fixing roller 31, a heating roller 623 to heat the pressing belt 621, and the pressing belt 621 wound around both of the heating roller 623 and the elastic roller 622. The pressing belt 621 is made rotatable in the arrow direction by the driving of one of the heating roller 623 and the elastic roller 622.

As shown in an enlarged view, the pressing belt 621 comprises a heat-resistant endless belt 621A made of such as polyimide resin, a heat-resistant elastic layer 621B made of such as a silicon rubber covered on the heat-resistant endless belt 621A, and an outermost layers 621C made of such as PFA formed on the heat resistant elastic layer 621B.

The fixing device 30 shown in FIG. 11(*a*) and FIG. 11(*a*) according to the present invention comprises an oscillating section 41 (not shown) to oscillate a pair of fixing members in the width direction and an inclining section 41 (not shown) to incline a nip portion to the width direction on an apparatus trestle section 40 (not shown) so that the pair of fixing members 61, 32 (or 31, 62) are made to be able to oscillate in the width direction and to incline to the width direction.

In the image forming apparatus A employing the abovementioned belt type fixing device according to the present invention, when a sheet passes through the nip portion, the oscillating section 41 and the inclining section 42 are controlled in such a way that one-sided oscillation shift of a sheet by the oscillating section and one-sided inclination shift of the sheet by inclination of the nip portion become opposite to each other. As a result, the image forming apparatus A is provided with an excellent fixing performance without fixing unevenness and fixing failure and a stable sheet conveying performance without sheet wrinkle and sheet crease, and the image forming apparatus A makes it possible to realize the longer service life of a pair of fixing members by oscillating the pair of fixing members in the width direction for a sheet S so as to prevent local repetition abrasion for the fixing member by edge portions of sheets.

The abovementioned embodiments capable of achieving the object of the present invention can be summarized as follows.

Item 1. In an image forming apparatus equipped with an image forming section to form a toner image on a sheet, and a fixing device which has a pair of fixing members coming in pressure contact with each other and forming a nip portion and fixes the toner image on the sheet conveyed from the image forming section with the nip portion, the image forming apparatus is characterized by comprising:

an oscillating section to oscillate the pair of fixing members in a width direction perpendicular to a sheet conveying direction;

an inclining section to incline the nip portion to the width direction in parallel to a conveyance surface; and a control section to control the oscillating section and the inclining section such that when a sheet is passing through the nip portion, a one-sided oscillation shift of the sheet by the oscillating section and a one-sided inclination shift of the sheet due to the inclination of the nip portion are made opposite in direction to each other.

Item 2. The image forming apparatus described in Item 1 is characterized in that the control section makes a difference between the speed of the one-sided oscillation shift and the speed of the one-sided inclination shift to be small to an extent not to cause wrinkles on the fixed sheet.

Item 3. The image forming apparatus described in Item 1 or 2 is characterized in that the control section switches the inclination direction by the inclining section in accordance with switch-over of the oscillation direction by the oscillating section.

Item 4. The image forming apparatus described in one of Items 1 to 3 is characterized in that the control section changes the inclination angle of the nip portion to the width direction in parallel to a conveyance surface by the inclining section in accordance with the oscillation speed of the pair of fixing members by the oscillating section.

Item 5. The image forming apparatus described in one of Items 1 to 3 is characterized in that the control section changes the oscillation speed of the pair of fixing members by the oscillating section in accordance with the inclination angle of the nip portion to the width direction in parallel to a conveyance surface by the inclining section.

Item 6. The image forming apparatus described in one of Items 1 to 5 is characterized in that the oscillating section can oscillate the fixing device in the width direction.

Item 7. The image forming apparatus described in one of Items 1 to 6 is characterized in that the inclining section can incline the fixing device to the width direction in parallel to a conveyance surface.

Item 8. The image forming apparatus described in one of Items 1 to 7 is characterized in that the fixing members are a roller in which a heat resistant resin is formed on a roller-shaped base member.

Item 9. The image forming apparatus described in one of Items 1 to 7 is characterized in that one of the fixing members is an endless belt which is made of a heat resistant resin and arranged to be rotatable.

The present invention makes it possible to provide an image forming apparatus which comprises an oscillating section to oscillate a pair of fixing members in a width direction perpendicular to a sheet conveying direction and an inclining section to incline the nip portion to the width direction in parallel to a conveyance surface and controls the oscillating section and the inclining section such that when a sheet is passing through the nip portion, a one-sided oscillation shift of the sheet due to the oscillating section and a one-sided inclination shift of the sheet due to the inclination of the nip portion are made opposite in direction to each other so as to cancel each other, whereby the longer service life of the fixing rollers can be realized without causing problems of fixing unevenness and sheet wrinkles.

What is claimed is:

1. An image forming apparatus, comprising:

an image forming section to form a toner image on a sheet;

a fixing device having a pair of fixing members coming in pressure contact with each other so as to form a nip portion and to fix the toner image on the sheet conveyed from the image forming section with the nip portion;

an oscillating section to oscillate the fixing members in a width direction perpendicular to a sheet conveying direction;

an inclining section to incline the fixing members at an inclination angle to the width direction in parallel to a conveyance surface; and a control section to control the oscillating section and the inclining section such that when a sheet is passing through the nip portion, a direction of a one-sided oscillation shift of the sheet due to the oscillation of the fixing members is made opposite relatively to that of a one-sided inclination shift of the sheet due to the inclination of the fixing members.

2. The image forming apparatus described in claim 1, wherein the control section makes a difference between a speed of the one-sided oscillation shift and a speed of the one-sided inclination shift to be small to an extent not to cause wrinkles on the fixed sheet.

3. The image forming apparatus described in claim 1, wherein the control section switches over an inclination direction of the fixing members by the inclining section in accordance with switch-over of an oscillation direction of the fixing members by the oscillating section.

4. The image forming apparatus described in claim 1, wherein the control section changes the inclination angle of the fixing members to the width direction by the inclining section in accordance with an oscillation speed of the fixing members by the oscillating section.

5. The image forming apparatus described in claim 1, wherein the control section changes an oscillation speed of the fixing members by the oscillating section in accordance with the inclination angle of the fixing members to the width direction by the inclining section.

6. The image forming apparatus described in claim 1, wherein the oscillating section oscillates the fixing device together with the fixing members in the width direction.

7. The image forming apparatus described in claim 1, wherein the inclining section inclines the fixing device together with the fixing members to the width direction in parallel to a conveyance surface.

8. The image forming apparatus described in claim 1, wherein the fixing members are a roller in which a heat resistant resin is formed on a roller-shaped base member.

9. The image forming apparatus described in claim 1, wherein one of the fixing members is an endless belt which is made of a heat resistant resin and arranged to be rotatable.

* * * * *